US005145197A

United States Patent [19]

Gatti

[11] Patent Number: 5,145,197

[45] Date of Patent: Sep. 8, 1992

[54] FOLDING WHEELCHAIR WITH RIGID SEAT

[75] Inventor: Armand Gatti, New Rochelle, N.Y.

[73] Assignee: Contemporary Medical Equipment Corp., Mamaroneck, N.Y.

[21] Appl. No.: 97,959

[22] Filed: Sep. 14, 1987

[51] Int. Cl.[5] ..... A47C 4/12

[52] U.S. Cl. ..... 280/304.1; 280/42; 297/44; 297/45; 297/69; 297/379; 297/396; 297/430; 301/63 R; 188/2 F

[58] Field of Search ..... 280/242 WC, 657, 42, 280/242.1, 304.1, 250.1; 297/16, 42, 43, 44, 53, 59, 60, 69, 313, 314, 331, 332, 337, 353-355, 377-379, 396, 406, 423, 430, 45; 301/63 R, 63 D, 63 DD; 188/2 F, 19, 382

[56] References Cited

U.S. PATENT DOCUMENTS

| | | | |
|---|---|---|---|
| 667,986 | 2/1901 | Meade | 297/53 |
| 2,654,416 | 10/1951 | Maniscalco | 188/2 F |
| 3,158,404 | 11/1964 | Noakes | 301/63 D |
| 3,302,757 | 3/1965 | Eagleson | 188/2 F |
| 3,666,292 | 5/1972 | Bartos | 280/242 WC |
| 3,761,129 | 9/1973 | Schultz | 297/DIG. 4 |
| 3,833,256 | 9/1974 | Dehner | 297/44 |
| 3,854,774 | 12/1974 | Limpach | 297/429 |
| 3,858,938 | 1/1975 | Kristensson et al. | 297/429 |
| 3,881,773 | 5/1975 | Rodaway | 297/377 |
| 3,882,949 | 5/1975 | Anderson | 280/242 WC |
| 3,887,228 | 6/1975 | Ingerson | 280/242 WC |
| 3,897,857 | 8/1975 | Rodaway | 297/DIG. 4 |
| 3,968,991 | 7/1976 | MacLaren | 297/45 |
| 4,007,959 | 2/1977 | Juergens | 297/42 |
| 4,042,250 | 8/1977 | Rodaway | 280/242 WC |
| 4,045,051 | 8/1977 | Igarashi et al. | 280/42 |
| 4,098,521 | 7/1978 | Ferguson et al. | 280/242 WC |
| 4,166,631 | 9/1979 | Sanaski | 280/242 WC |
| 4,170,368 | 10/1979 | Southward et al. | 280/242 WC |
| 4,204,588 | 5/1980 | Kawecki | 188/2 F |
| 4,241,932 | 12/1980 | Hartmann | 280/289 WC |
| 4,273,350 | 6/1981 | Williams | 280/242 WC |
| 4,326,732 | 4/1982 | Gall et al. | 280/650 |
| 4,339,013 | 7/1982 | Weigt | 280/242 WC |
| 4,343,482 | 8/1982 | Wegner | 280/42 |
| 4,350,227 | 9/1982 | Knoche | 188/2 F |
| 4,354,791 | 10/1982 | Antonellis | 280/289 WC |
| 4,358,125 | 11/1982 | Charles | 280/242 WC |
| 4,362,311 | 12/1982 | Bergman | 280/242 WC |
| 4,365,924 | 12/1982 | Brigman et al. | 280/289 WC |
| 4,366,964 | 1/1983 | Farey | 280/242 WC |
| 4,371,183 | 2/1983 | Dion | 280/42 |
| 4,375,295 | 3/1983 | Volin | 280/289 WC |
| 4,380,343 | 4/1983 | Lovell et al. | 280/242 WC |
| 4,392,690 | 7/1983 | Anderson | 280/647 |
| 4,421,336 | 12/1983 | Petrofsky et al. | 280/242 WC |
| 4,457,535 | 7/1984 | Takeuchi et al. | 280/650 |
| 4,462,604 | 7/1984 | Meyer | 280/242 WC |
| 4,477,098 | 10/1984 | Minnebraker | 280/647 |
| 4,484,780 | 11/1984 | Thompson | 297/DIG. 4 |
| 4,486,048 | 12/1984 | Meyer | 297/433 |
| 4,489,955 | 12/1984 | Hamilton | 280/242 WC |
| 4,493,488 | 1/1985 | Panaia et al. | 280/242 WC |
| 4,500,109 | 2/1985 | Volin | 280/289 WC |
| 4,514,867 | 5/1985 | Jensen | 297/DIG. 4 |
| 4,542,918 | 9/1985 | Singleton | 280/650 |
| 4,553,770 | 11/1985 | Lyman | 280/289 WC |
| 4,555,121 | 11/1985 | Lockard et al. | 280/650 |
| 4,565,385 | 1/1986 | Morford | 280/289 WC |
| 4,572,577 | 2/1986 | LaRue | 297/430 |
| 4,592,570 | 6/1986 | Nassiri | 280/242 WC |
| 4,648,619 | 3/1987 | Jungnell | 280/242 WC |
| 4,655,471 | 4/1987 | Peek | 280/242 WC |
| 4,721,321 | 1/1988 | Haury | 280/242 WC |
| 4,730,842 | 3/1988 | Summers | 280/657 |
| 4,733,755 | 3/1988 | Manning | 188/2 F |
| 4,754,987 | 7/1988 | Williams | 280/304.1 |
| 4,770,432 | 9/1988 | Wagner | 280/250.1 |

*Primary Examiner*—Charles A. Marmor
*Assistant Examiner*—A. M. Boehler
*Attorney, Agent, or Firm*—Rosenman & Colin

[57] ABSTRACT

A folding wheelchair has a rigid seat, leg support members stored in a compartment within the seat, a rigid backrest that can be collapsed when the wheelchair is folded, armrests that can be swung toward the seat or the backrest, and wheels that can be adjusted to raise or lower the seat and/or to shorten or lengthen the wheelbase. The rigid seat can be raised to a position in which the front or the front and rear portions are elevated.

24 Claims, 9 Drawing Sheets

FIG. 6
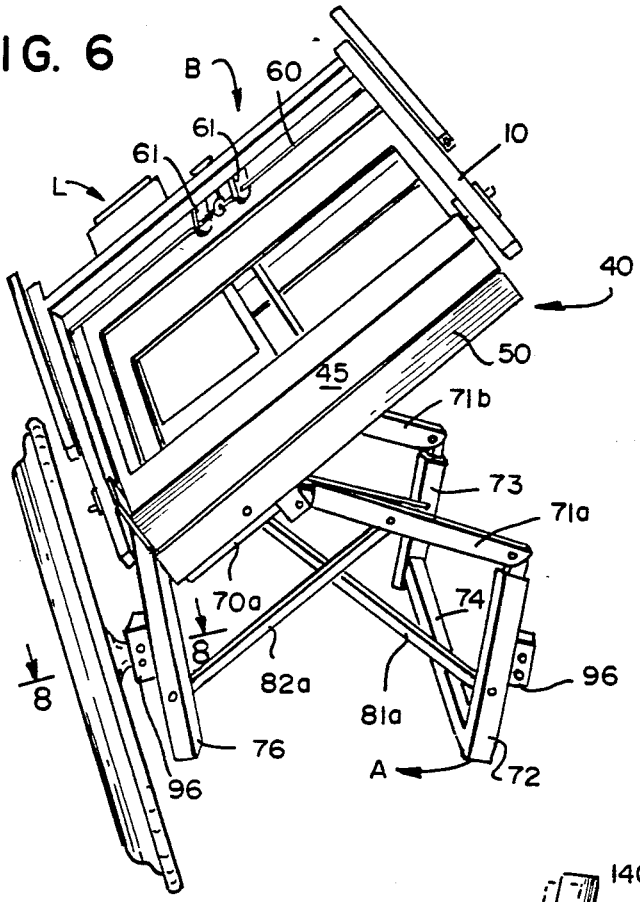
FIG. 7
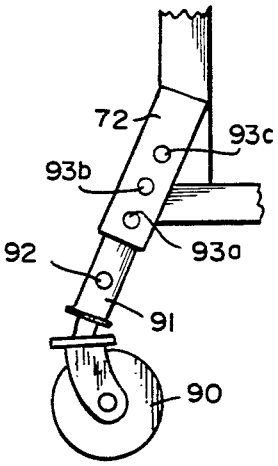
FIG. 9
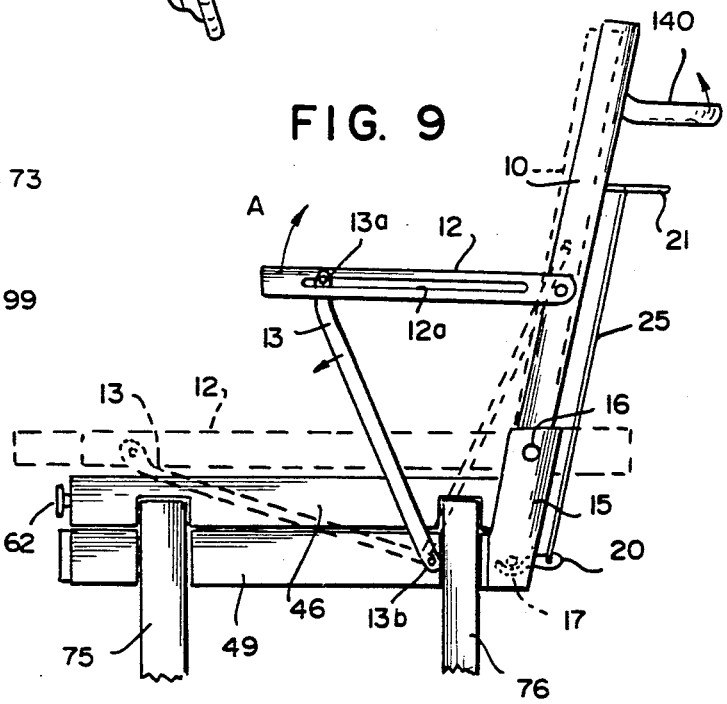
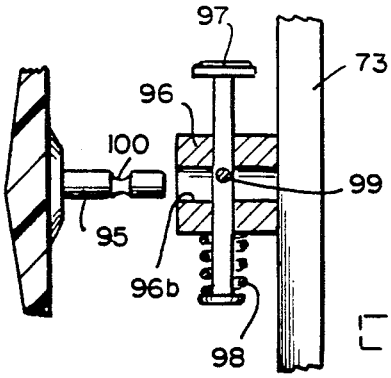
FIG. 8

FIG. 10
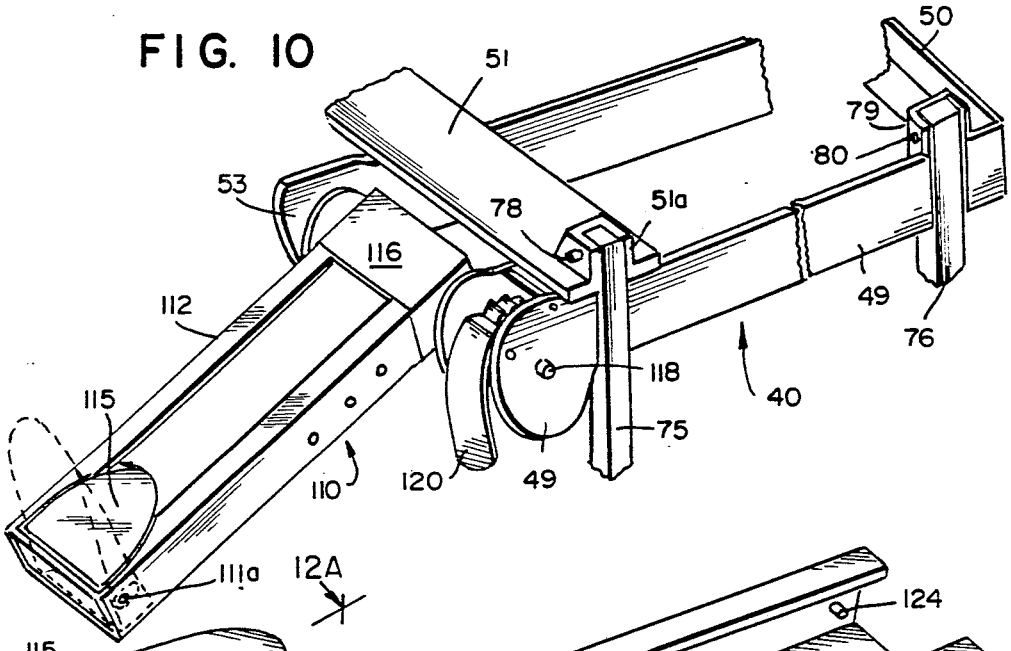
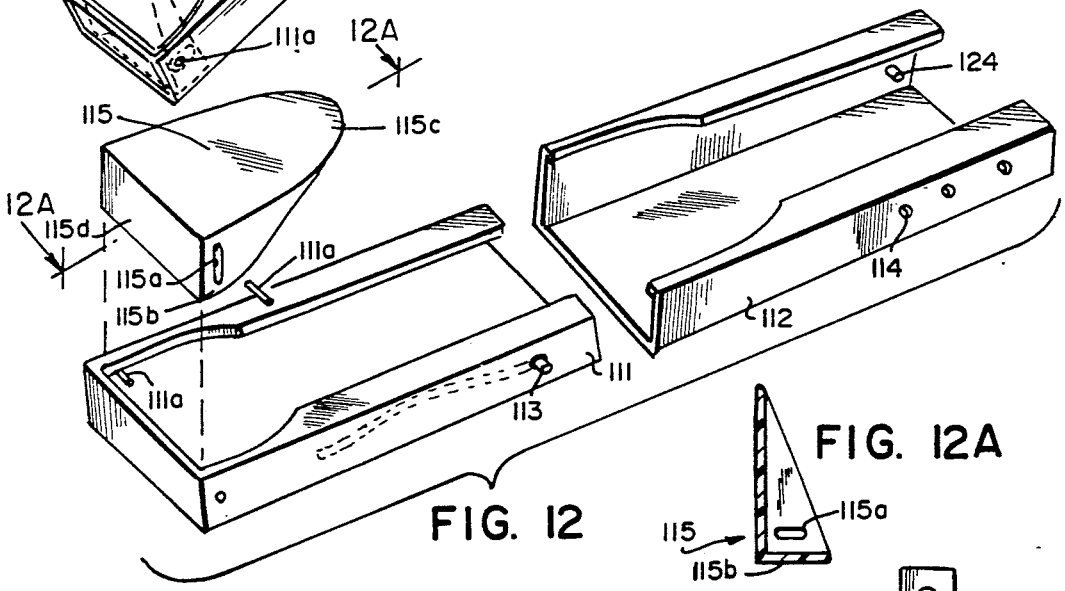
FIG. 12
FIG. 12A
FIG. 11
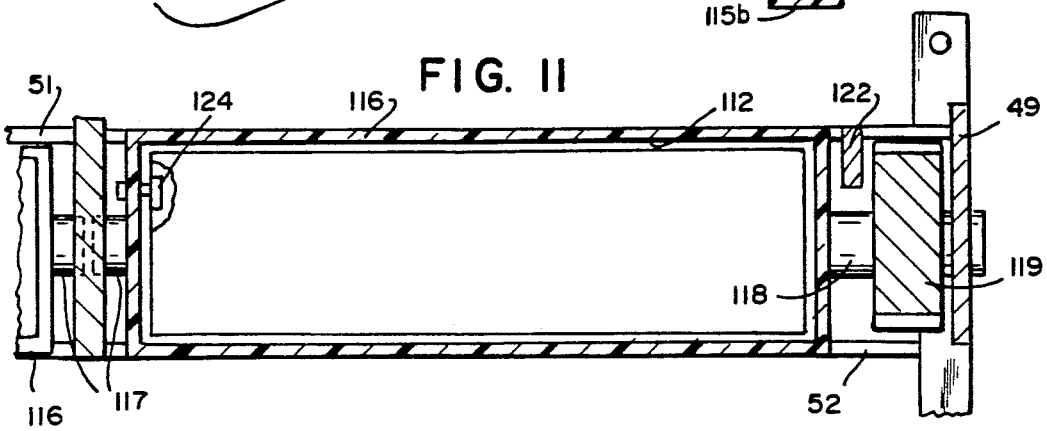

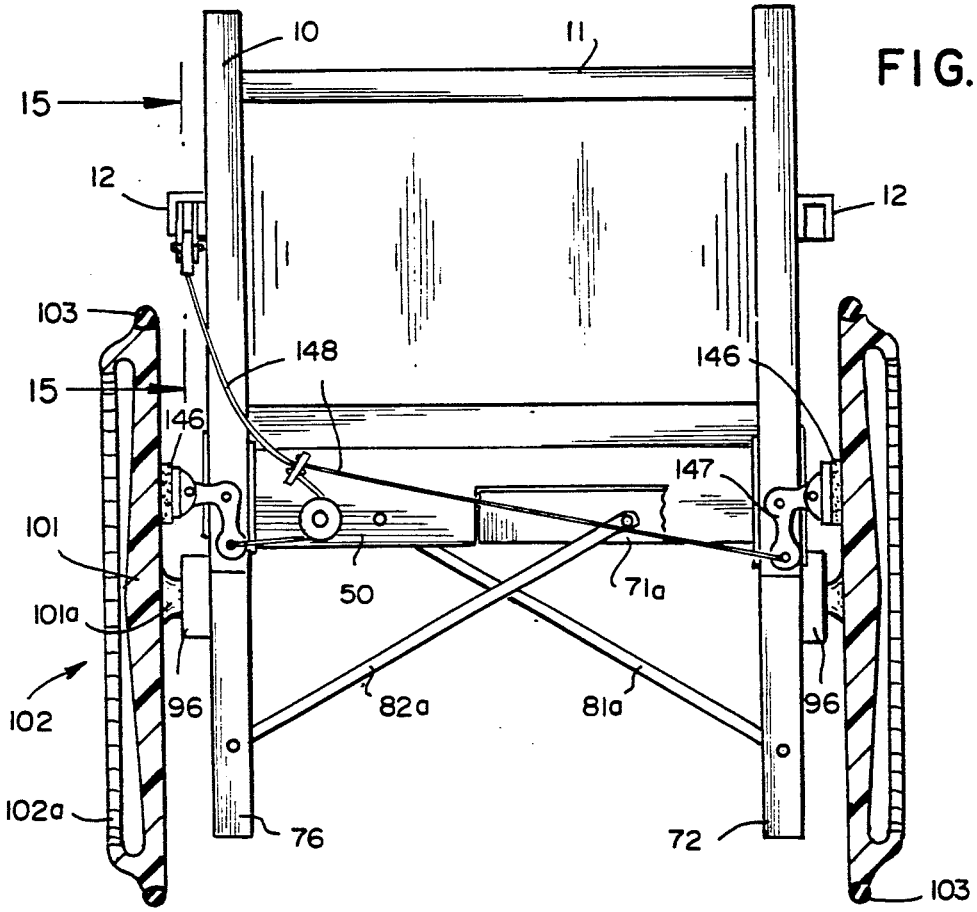
FIG. 14
FIG. 15
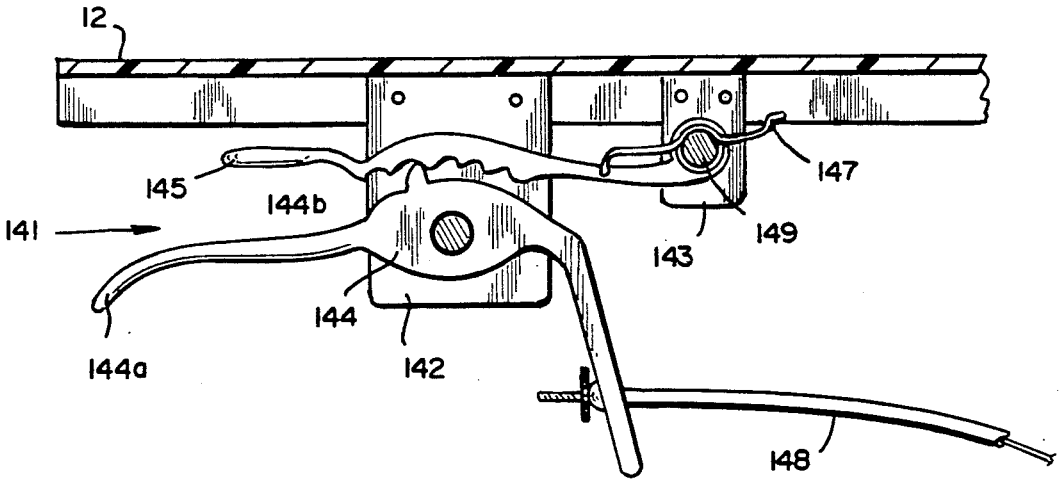

FOLDING WHEELCHAIR WITH RIGID SEAT

The present invention is directed to a fully adjustable and modular folding wheelchair that is designed to provide maximum comfort to the individual user, while at the same time enabling a health care facility to change the configuration of the chair to meet differing needs of different patients.

Conventional folding wheelchairs have a seat and backrest made of fabric or of natural or synthetic leather. The conventional seat only provides marginal comfort and support to a seated patient because it must be sufficiently flexible to be folded when the two sides of the wheelchair are collapsed together in the conventional folding wheelchair construction. A seat flexible enough to be folded will not provide proper support and comfort for the patient. The conflicting goals of collapsibility of the wheelchair and comfort for the patient are inevitably resolved in favor of collapsibility, thereby providing the uncomfortable wheelchairs currently available.

A further deficiency of conventional wheelchairs is that the seat has but one position. A short patient cannot lower the seat and a tall patient cannot raise it. In addition, elderly patients can slide out of the wheelchair, such as when asleep.

While small improvements have been made in the individual components of the wheelchair, the result invariably is a wheelchair that addresses only one specific user need and cannot be adjusted to suit the comfort of a particular patient, much less different patients of different needs and sizes.

The present invention provides a folding wheelchair that has been redesigned from the ground up. The wheelchair of the invention can be configured and/or adjusted to meet the needs and size of virtually any patient. The fully adjustable wheelchair according to the present invention does not sacrifice comfort for foldability because the folding mechanism of the wheelchair of the present invention complements rather than conflicts with the comfort features thereof.

In one embodiment of the present invention, a foldable wheelchair is provided having a rigid seat assembly that is adapted to provide comfortable support for a seated patient. The rigid seat assembly is swingably mounted on a collapsible carriage, whereby the wheelchair when folded will be compact and can be stored or transported while occupying only a small space. Since the wheelchair according to the invention is folded by swinging the seat assembly about the carriage, rather than by folding the seat, the seat assembly can be as rigid as desired for proper support of the patient without interfering with the collapsibility of the wheelchair. By means of the present invention, the requirements for proper seating support can be isolated from collapsibility and can thus be separately dealt with and optimized.

In another embodiment of the invention, the seat assembly can be raised from a first position to an elevated position to accommodate taller people. The seat assembly is also operable such that the seat can be raised to an intermediate position in which the front of the seat is elevated with respect to the rear of the seat. This articulating feature helps prevent a patient from sliding out of the seat. The collapsible carriage also enables the seat assembly to be adjustable as described without affecting collapsibility of the wheelchair.

In a further embodiment of the invention, the driving and driven wheels are adjustable with respect to the carriage to raise or lower the wheelchair (and hence the seat thereof) as desired. The adjustability of the wheels cooperates with the adjustability of the seat assembly to place the seat at the proper height for short and tall persons alike.

In a further embodiment of the invention, the driving wheels are also adjustable to shorten or lengthen the wheel base of the wheelchair as well as being adjustable to raise or lower the wheelchair. Adjustability of the wheel base is a desirable feature so as to enable the wheelchair more safely to accommodate amputees. As is known, an amputee seated in a wheelchair will shift the center of gravity toward the back and hence the wheelchair requires a longer wheelbase for greater safety.

In a further embodiment of the invention, a collapsible and reclinable rigid backrest assembly is provided which is mounted to the seat assembly. When the wheelchair is folded, the backrest is swung from a normal upright position to a collapsed position in which the back assembly confronts the seat assembly. The backrest can be rigid because it does not change its shape while being collapsed. In conventional folding wheelchairs, the backrest must be folded to be collapsed, thereby requiring the use of a flexible backrest. In the present invention, a rigid backrest can be used to provide adequate support and comfort for the patient, since in the present invention, the backrest is not folded together when the wheelchair is collapsed for storage.

In accordance with the present invention, the backrest may be adjustably reclinable over a wide range of positions to provide maximum comfort for any given patient. The adjustable reclinability of the backrest also enables a patient to change the attitude of the backrest over the course of a day to suit his or her personal needs.

In a further embodiment of the invention, the back assembly is provided with arms that can be swung from their normal horizontal position to a raised position where they are adjacent the backrest. This allows the user of the wheelchair the convenience of pulling the wheelchair up to and under a desk or table of a standard height without interference of fixed arms or the need to remove the arms from the wheelchair. Further, when the arms are in the raised position, it is easier to assist or carry a patient into and out of the wheelchair.

In a further embodiment of the invention, the wheelchair includes adjustable and retractable leg supports The leg supports can be retracted when not needed and/or when the wheelchair is collapsed, thus providing a more compact package. The leg supports are telescopically adjustable over a wide range to suit legs of various lengths and the leg rests are also adjustable to place them in any desired position of elevation.

In another embodiment of the invention, the wheelchair is provided with a braking system operated by a hand grip located on the arm of the wheelchair. In conventional wheelchairs, the manually operated actuator for brakes or wheel locking devices is usually located at or on the front of each wheel, which causes accidents. Thus, it is commonplace for a patient or user of a conventional wheelchair to catch a finger, hand, clothing or the like in the brake, wheel locks and/-spokes of the wheel. The actuator for braking system employed in the present invention is safely and easily activated because it is conveniently located under one of the armrests and thus remote from the wheels.

In another embodiment of the invention, the driving wheels are fully detachable from the carriage and are preferably formed as solid discs (without spokes) with the handwheel and the driving wheel formed as a unitary assembly from plastic.

The present invention is illustrated in the accompanying drawings in terms of its preferred embodiments, in which:

FIG. 6 is a perspective view of the wheelchair in a position between fully open and fully collapsed with parts removed for clarity;

FIG. 7 is a detail view of a driven wheel of the wheelchair;

FIG. 8 is a detail view, taken in section along lines 8—8 of FIG. 6 of the mechanism for removably securing the driving wheel to the wheelchair;

FIG. 9 is a side elevation view of the wheelchair illustrating the collapsible back assembly;

FIG. 10 is a detail view in perspective of a portion of the seat assembly and showing the leg support assembly;

FIG. 11 is a detail view in enlarged scale in section of the leg support assembly;

FIG. 12 is a perspective view of the telescoping members of the leg support assembly;

FIG. 12A is a view taken in section along lines 12A—12A in FIG. 12;

FIG. 14 is a rear elevational view of the wheelchair of FIG. 1 showing the braking assembly and the construction of the driving wheels;

FIG. 15 is a detail view of the operator for the braking system;

Figure 1:
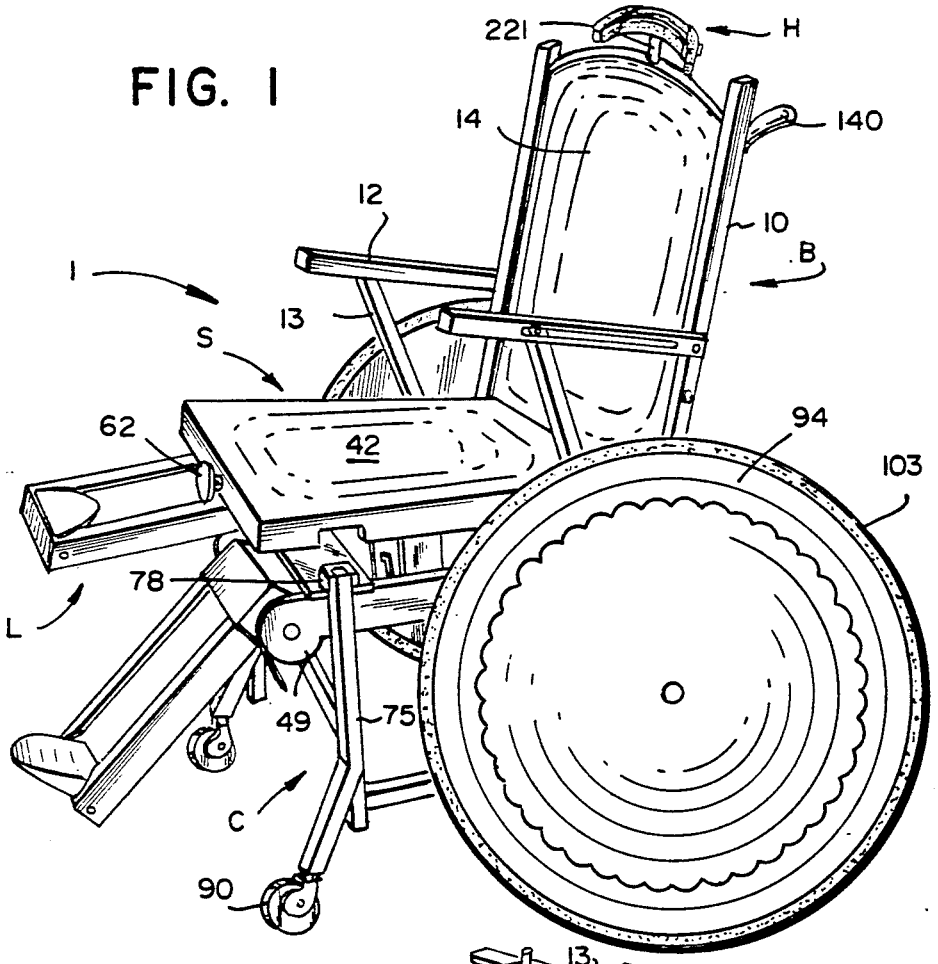
FIG. 1 is a perspective view of the wheelchair according to the present invention with the seat assembly in the fully raised position.

As seen in FIG. 1, the wheelchair 1 of the invention comprises a seat assembly S and a back assembly B, which are supported by folding carriage C. Back assembly B in turn supports headrest H. Wheelchair 1 also includes removable and adjustable front wheels 90 and rear wheels 94 and adjustable and retractable leg support assemblies L. As will be described in detail hereinafter, the wheelchair 1 is fully collapsible for ease of storage and transportation. Further, the seat assembly S, back assembly B, leg support assemblies L, headrest H, front wheels 90 and rear wheels 94 are fully adjustable to provide maximum comfort to the patient.

Collapsible And Reclinable Backrest And Arms

The back assembly B of wheelchair 1 (FIG. 1) comprises uprights 10, crossbar 11 (FIG. 14), arms 12 and braces 13. Secured to uprights 10 is a rigid backrest 14, which may be of plastic and which may be padded, if desired. Back assembly B is shown in the fully erect position in FIGS. 1 and 9, but is collapsible to the position shown in FIGS. 2 and 6.

Figure 9A:
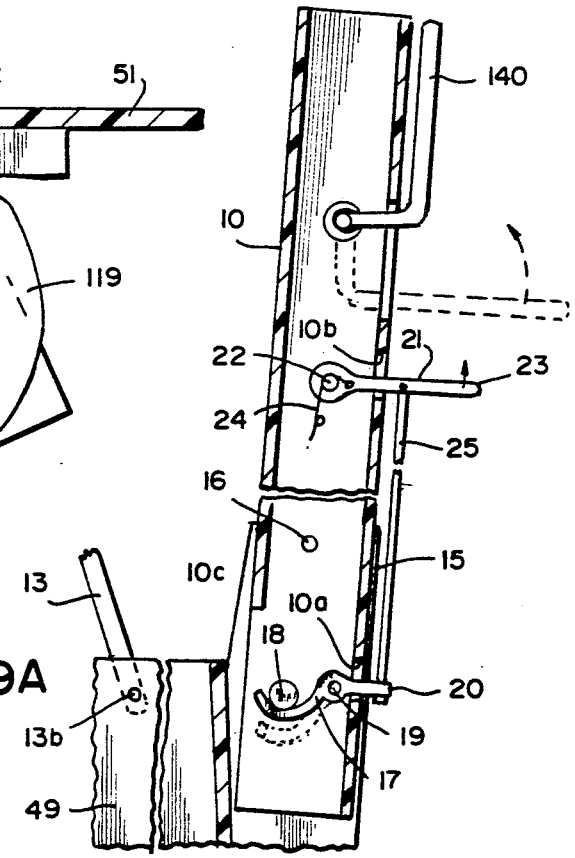
FIG. 9A is a detail view in section of a portion of the collapsible back assembly.

Uprights 10 are pivotally mounted in supports 15 by pins 16 (FIG. 9) carried by supports 15 and are locked in the slightly reclined, upright position shown in FIGS. 9,9A by hook 17 that normally engages post 18 carried by supports 15. Hook 17 is pivotally mounted to upright 10 by pin 19 and end 20 extends out of slot 10*a* in upright 10. Operating lever 21 is pivotally mounted at one end to upright 10 by pin 22, while the other end 23 projects through slot 10*b* in upright 10. A spring 24 normally urges lever 21 to rotate about pin 22 in a clockwise direction as viewed in FIG. 9A, and since linkage arm 25 connects lever 21 and hook 17, the hook 17 is thus urged into engagement with post 18, to lock back B in place. When lever 21 is pulled upwardly as viewed in FIG. 9A, the hook 17 is disengaged from post 18, thereby allowing the uprights 10 to be swung to the collapsed position about pivots 16 as shown in dotted line in FIG. 9A. The lower end of each upright 10 is cut away at 10*c* to enable the uprights 10 to clear posts 18 as they are swung to the collapsed position. Braces 13 (FIG. 9) are pivotally connected at one end to arm 12 via pin 13*a* and at the other end to arm 48 or 49, respectively, of the seat support member 40, to support arms 12 when the back assembly B is raised and to permit the back assembly B to be collapsed.

Arms 12 each have a slot 12*a* that cooperates with pin 13*a* to enable each arm 12 to be swung independently upwardly in the direction of arrow A (FIG. 9) to the near vertical position shown in dotted line. With one or both of arms 12 thus raised, it is easier to assist or carry a patient on or off the wheelchair. Further, by raising both arms 12 the wheelchair may be moved under a table or desk for the added comfort and convenience for the patient when using the same.

Figure 9B:
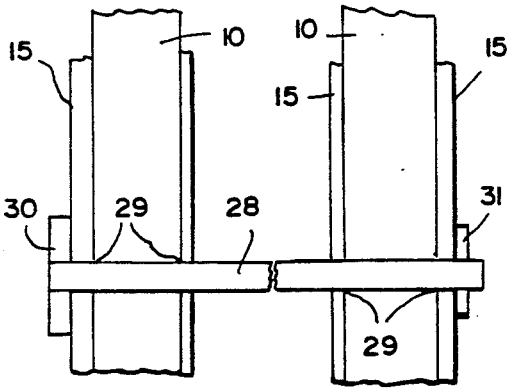
FIGS. 9B and 9C are detail views of an alternative embodiment of the invention, wherein the backrest may be adjustably reclined.
Figure 9C:
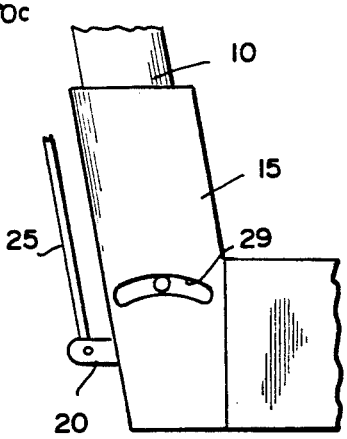

Backrest 14 may be adjustably reclinable, if desired, as in the preferred embodiment shown in FIGS. 9B and 9C. Thus, uprights 10 are pivotally mounted on rod 28, which extends through apertures 29 provided in the supports 15. One end of rod 28 has wheel 30 threadedly secured thereto while the other end carries a circular flange 31. For simplicity of illustration, wheel 30 is omitted from FIG. 9C.

To adjust the position of the backrest 14, wheel 30 is first loosened thereby allowing rod 28 to be moved to the desired position in slot 29, after which wheel 30 is tightened to lock the backrest 14 in place. To collapse backrest 14, the hook 17 is released as described above, whereby the uprights 10 may be pivoted about rod 28 and swung downwardly toward the seat. If necessary, wheel 30 may be slightly loosened to allow uprights 10 to be swung about rod 29 to the collapsed position.

Multi-Position Folding Seat

Figure 3:
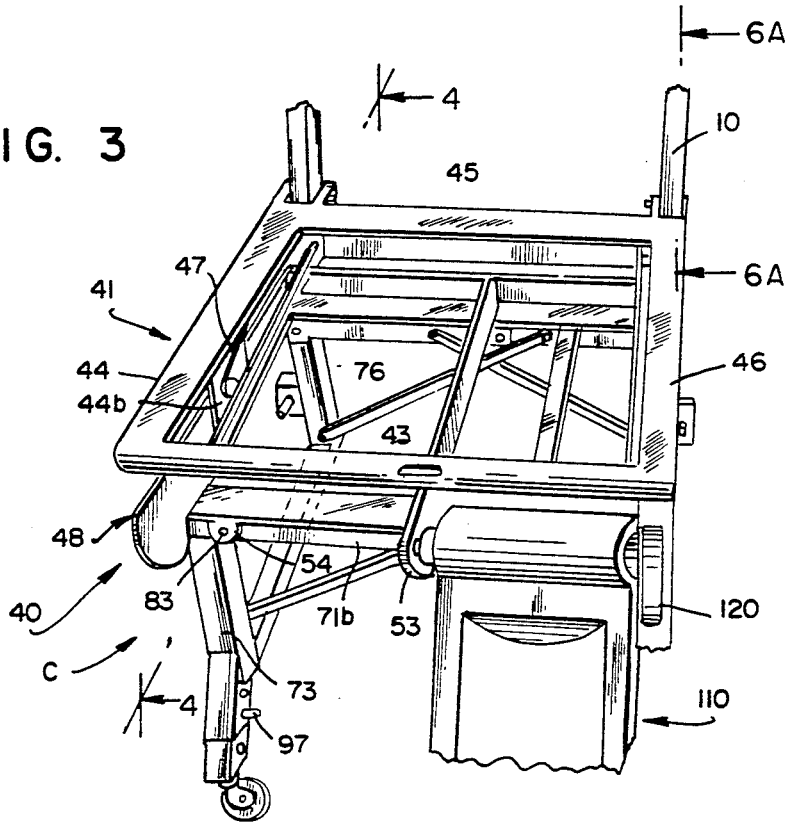
FIG. 3 is a perspective view of the seat assembly.
Figure 4:
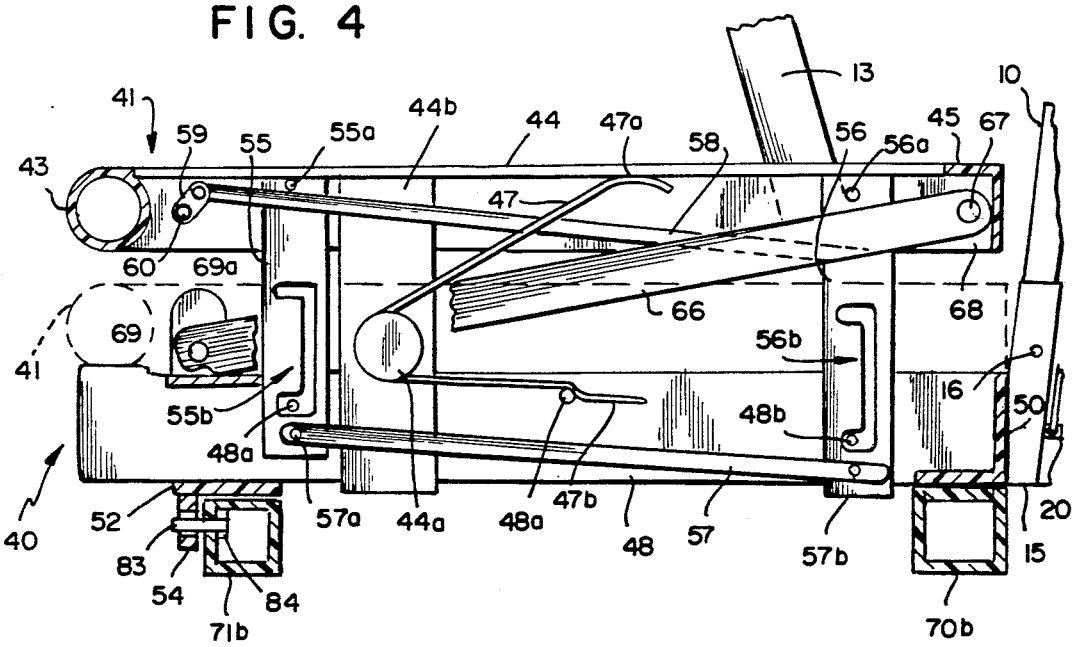
FIG. 4 is a detail view in enlarged scale taken in section along lines 4—4 of FIG. 3.
Figure 5:
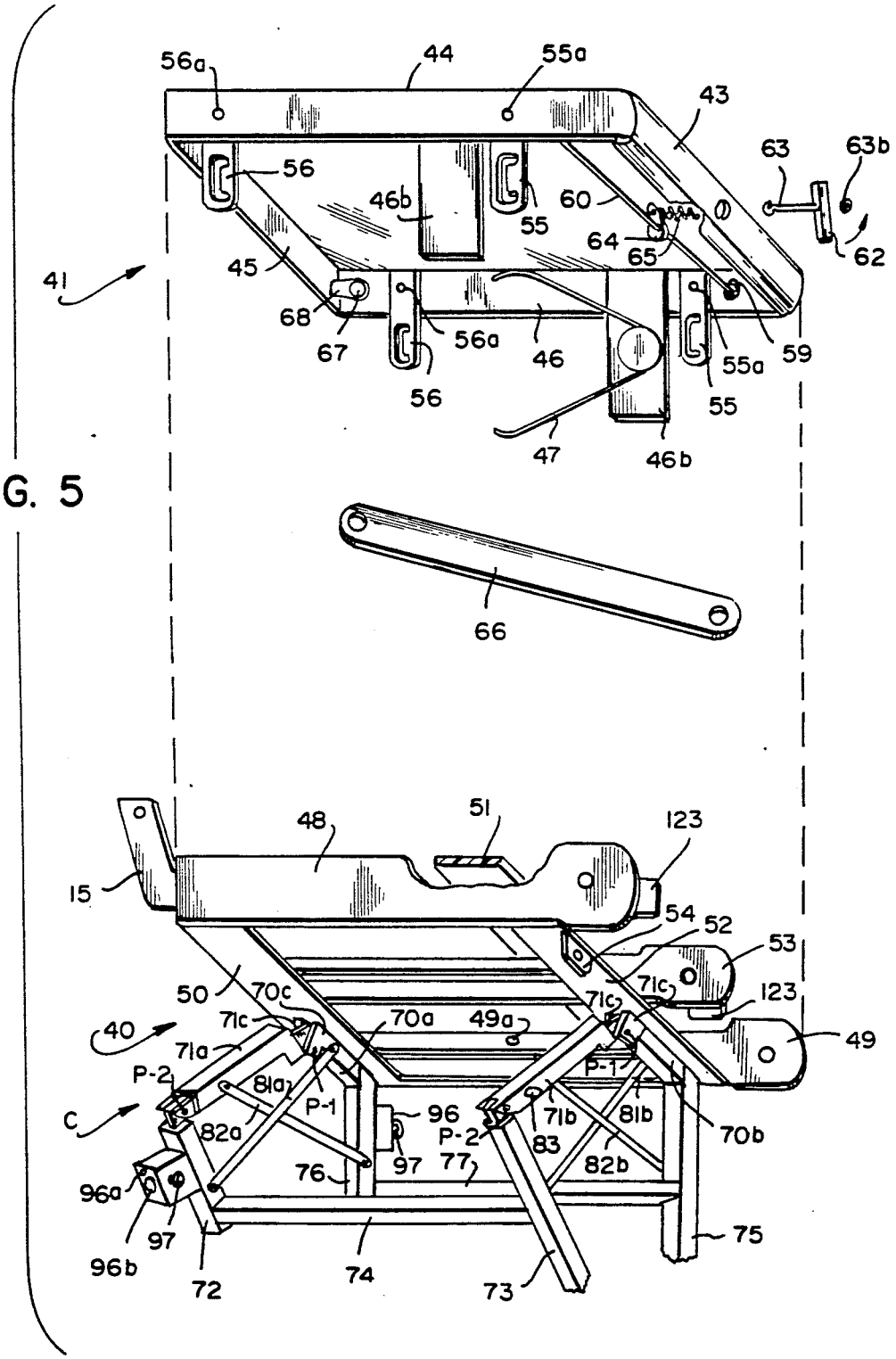
FIG. 5 is an exploded view, in perspective, of the seat assembly and a portion of the carriage.

As seen in FIGS. 3–5, seat assembly S comprises seat support member 40 which carries movable seat member 41. Depending from and secured to seat support member 40 is the carriage C, which will be described in detail below. Contoured rigid plastic seat 42 (FIG. 1), which may be padded, is secured to seat support member 40 (FIG. 3}by any suitable fastening means. For clarity, seat 42 has been removed from the drawings except for FIG. 1.

Movable seat member 41 (FIG. 3) comprises members 43–46 joined together to form a rigid frame, which is urged away from seat support member 40 by the bias of springs 47 bearing on members 44,46. As best seen in FIG. 5, seat support member 40 comprises side arms 48,49 that are connected to rear seat frame member 50 and upper and lower frame front frame members 51,52 to form a rigid frame. Extending between and connected to rear frame member 50 and upper and lower front frame members 51,52 is shaft support member 53 to be described in detail below. Depending from lower frame member 52 is apertured lug 54 (FIG. 4) which cooperates with locking pin 83 to lock the wheelchair in its fully open position shown in FIGS. 1 and 3.

As shown in FIG. 4, spring 47 is secured to post **44*a* which is carried by bracket 44*b*, which is in turn secured to frame member 44. The upper free end 47*a* of spring 47 bears against frame member 44 while the lower arm 47*b* bears against pin 48*a* secured to to side arm 48. In this manner, spring 47 urges frame member 44 away from side arm 48. Frame member 46 and side arm 49 are similarly urged apart by the spring 47 mounted on bracket 46*b* (FIG. 5) the other side of wheelchair 1 which bears against pin 49*a* and member 46**.

Movable seat member 41 is shown in the raised position in FIG. 3 and in solid line in FIG. 4. The movable seat member 41 is locked in the raised position but can be unlocked and then moved to the lowered position shown in dotted line in FIG. 4 as follows.

Apertured front and rear plates 55,56 are pivotally mounted on frame member 44 by means of pins **55*a* and 56*a* carried by arm frame member 44. Arm 46 likewise supports pivotally mounted apertured plates 55,56 (FIG. 5). Each set of plates 55,56 is linked together by lower linkage arms 57 pivotally connected to the lower ends of plates 55,56 via pins 57*a* and 57*b*. In this manner, plates 55,56 will swing in unison between the positions shown in full and dotted lines in FIG. 4A. When the movable seat member 40 is locked in the raised position, pins 48*a* and 48*b* mounted on side arm 48 (and corresponding pins 49*a*,49*b* mounted on side arm 49, not shown), will be located in the horizontal portion 55*c*,56*c* of slots 55*b*,56*b* in plates 55,56 as shown in FIGS. 4 and 4A. Each upper linkage arm 58 is pivotally mounted at one end to a plate 56 via pin 58*a* and is pivotally mounted at the other end to an elongated swivel 59. A rod 60 (FIG. 5) connects the two swivels 59 together, the rod 60 being supported by the apertured lugs 61 (FIG. 6) mounted on the front frame member 43. (For clarity, lugs 61 are not shown in FIG. 5**.)

The locking mechanism for the seat assembly S comprises operator 62 (FIGS. 4B and 5), which is carried by rod 63, which in turn passes through and is carried by member 43. Rod 63 is pinned at one end to the upper end of elongated swivel 64 via pin **63*a*, while the other end of rod 63 carries nut 63*b* threadedly secured thereto. The lower end of swivel 64 is fixedly secured to rod 60. Spring 65 is a compression spring normally urging the upper end of swivel 64 to swing in a clockwise direction as viewed in FIG. 4B, thereby urging rod 60 to rotate about its axis in a clockwise direction. Since the swivels 59 are likewise secured to rod 60, the upper ends thereof are also urged by spring 65 via rod 60 to move in a clockwise direction as viewed in FIG. 4A. Linkage arms 58 will thus be urged to the right by ring 65 via rod 60 and swivels 59 as shown in FIG. 4A thereby swinging plates 56 about pins 56*a* to the locked position shown in full line in FIG. 4A. The swinging movement of plates 56 is transmitted to plates 55 via linkage arm 57, so that pins 48*a* and 48*b* enter the lower portion 55*c*,56*c* of slots 55*b*,56*b* as shown in full line in FIG. 4A, to lock the seat member 41**.

Figure 4B:
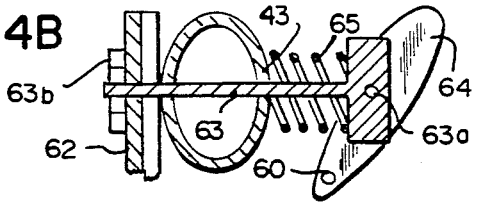
FIG. 4B is a detail view in section of the operator used to unlock the seat assembly.
Figure 4A:
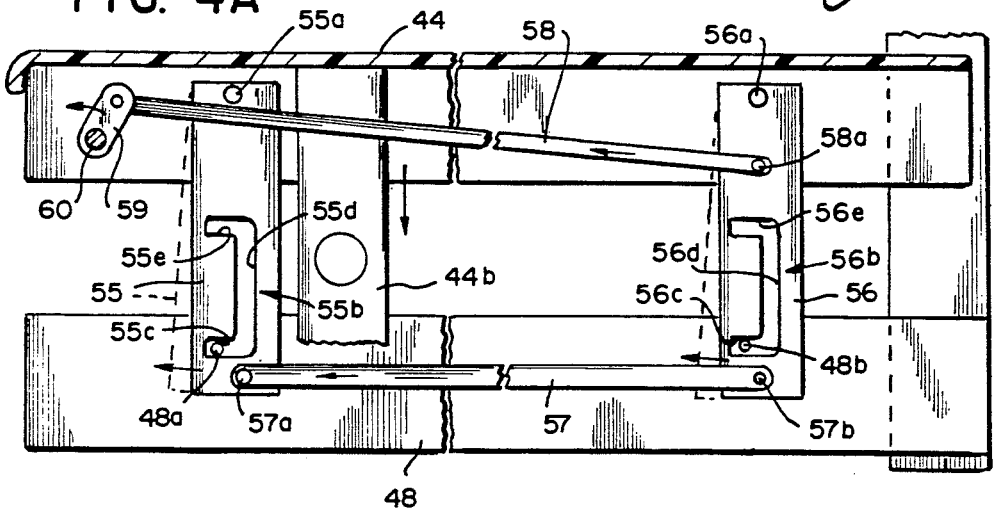
FIG. 4A is a detail view of a portion of FIG. 4 with parts removed for clarity.

With the seat member 41 locked in its raised position shown in FIG. 3, the locking mechanism may be unlocked by pulling the lower end of operator 62 to the left as viewed in FIG. 4B, thus rotating rod 60 and swivels 59 counterclockwise and moving the linkage arms 57,58 to the left, whereby pins **48*a*,49*a* and 48*b*,49*b* are moved out of the lower horizontal portions 55*c*,56*c* of slots 55*b*,56*b* and into the vertical portions 55*d*,56*d* thereof Movable seat member 41 can then be manually moved downwardly against the bias of springs 47, whereupon plates 55,56 also move downwardly with pins 48*a*,48*b*,49*a*,49*b* within the vertical portions 55*d*,56*d* of slots 55*b*,56*b*. Downward movement of movable seat member 41 is arrested when pins 48*a*,48*b*,-49*a*,49*b* contact the upper portion 55*e*,56*e* of slots 55*b*,56*b*, whereupon the spring 65 is now able to rotate swivel 64 and rod 60 clockwise as described above, which causes plates 55 and 56 to swing to the locked position in which pins 48*a*,48*b* are fully inside the upper portions 55*e*,56*e* of slots 55*b*,56*b***.

To raise seat member 41 from the fully lowered position, the operator 62 is pulled away from member 43, thus moving the pins **48*a*,49*a*,48*b*,49*b* into the vertical portions 55*d*,56*d* of slots 55*b*,56*b* whereby the seat rises under the action of springs 47**.

Arm 66 (FIG. 4) is provided at each side of the wheelchair 1 and is pivotally mounted via pin 67 at one end to a lug 68 carried by the rear frame member 45. The other end of arm 66 is pivotally mounted via pin 69 to a lug **69*a* carried by upper frame member 51. The arms 66 maintain proper alignment of the linkage mechanism as the seat member 41** is raised and lowered.

Figure 4C:
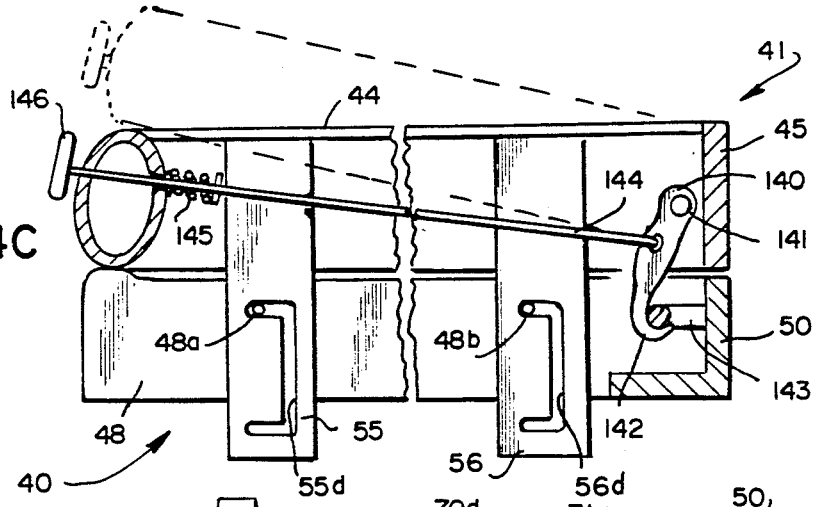
FIG. 4C is a detail view of a further embodiment of a locking mechanism.

A preferred embodiment of the invention is shown in FIG. 4C, wherein the movable seat member 41 is raised in two stages. In this embodiment, seat members 40,41 are as described above, and, in addition, a lever 140 is pivotally mounted on L-shaped pin 141 carried by frame member 45. Lever 140 has a hook 142 at one end that normally engages a bail 143 carried by frame member 50 and is pivotally connected between the two ends thereof to spring-loaded rod 144. Rod 144 is urged by spring 145 to the right as viewed in FIG. 4C, and operator 146 can be pulled to the left to disengage hook 142 from bail 143.

FIG. 4C shows the seat members 40,41 in the fully closed position. When operator 62 is pulled as described above, springs 47 (not shown) raise seat member 41 upwardly as described above but only the front of the seat member 41 will rise because hook 142 and bail 143 are engaged. The seat member 41 will be raised to the inclined position shown in dotted line in FIG. 4C. To raise the seat to its fully raised position, operator 146 is pulled to disengage the hook 142 from bail 143 and operator 62 is pulled to move pins 48*b*,49*b* into the vertical portions 56*d*, whereupon the seat member 41 will be urged by springs 47 to the fully raised position. Seat member 41 is returned to the fully lowered position by manually moving seat member 41 downwardly after actuation of operator 62 as described above, whereupon hook 142 will slide over bail 143 against the bias of spring 145 until it snaps into the locked position shown in FIG. 4C.

Collapsible Carriage

Figure 2:
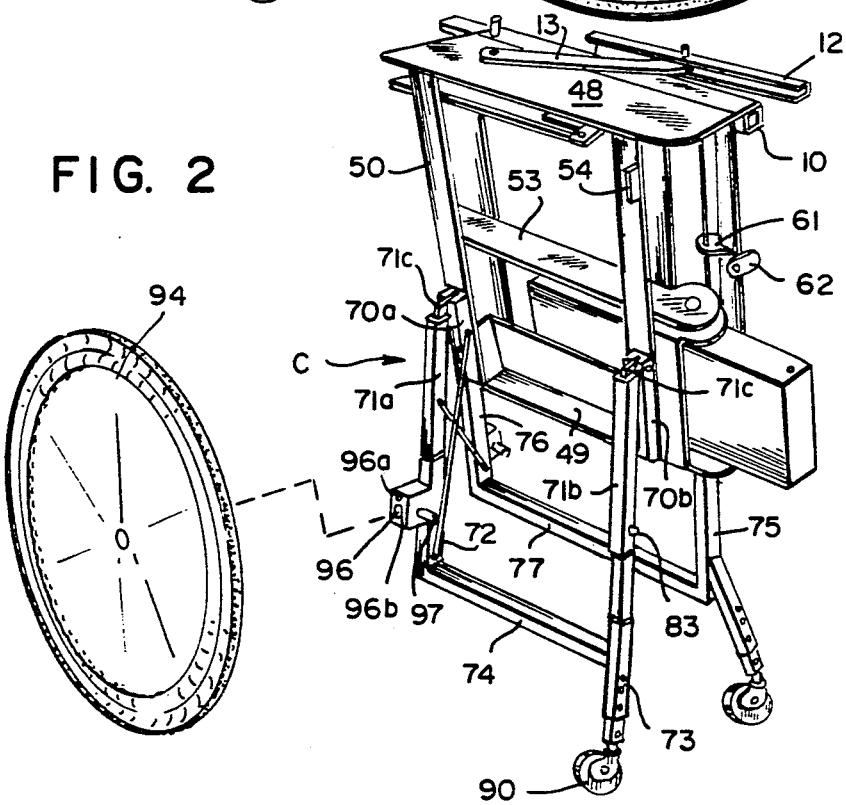
FIG. 2 is a perspective view showing the wheelchair in its fully collapsed position and with the rear wheels removed.

As shown in FIGS. 2 and 5, carriage C is mounted to seat support member 40 (FIG. 5) by securing fixed members 70*a* and 70*b* to rear frame member 50 and lower front frame member 52, respectively. Linkage members 71*a*,71*b* are pivotally connected at one end to the seat support member 40 by means of pin P-1 carried by fixed members 70*a*,70*b* and at the other end to rear wheel support leg 72 or to front wheel support leg 73, respectively, by means of pin P-2 (FIG. 5). Legs 72 and 73 are connected by brace 74. The other front wheel support leg 75 and rear wheel support leg 76 are braced by brace 77 and are hingedly connected to the side of seat support member 40 as most clearly seen in FIG. 10. In particular, front wheel support leg 75 is hingedly connected to upper frame member 51 by means of a fitting 51*a* that receives the upper end of front wheel support leg 75 and pin 78 that hingedly joins fitting 51*a* to member 75. Rear wheel support leg 76 is similarly hingedly connected to side arm 49 by means of fitting 79 and pin 80. In this manner, the seat support member 40 and the movable seat member 41 can be swung about pins 78 and 80 relative to legs 75 and 76 to fold or unfold the carriage C.

It is an important feature of the invention that pins 78 and 80 (FIG. 10) are mounted above and preferably inwardly of the seat support member 40 in order to allow seat members 40,41 to swing about pins 78,80 to the fully collapsed position in which seat members 40,41 are transverse to the horizontal without contacting the left wheel 94. As seen in FIG. 1, the left wheel 94 extends forwardly along a substantial portion of the side arm 49 of seat support member 40, and hence contact between seat members 40,41 and the left wheel 94 must be prevented since such contact would prevent the carriage C from fully closing.

Figure 6A:
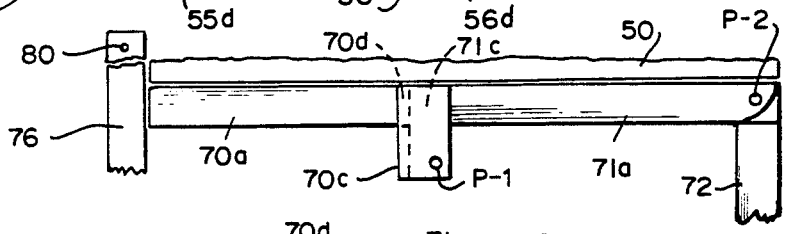
FIG. 6A-6C are detail views of the pivotal connection of the linkage member of the carriage to a leg of the carriage.
Figure 6B:
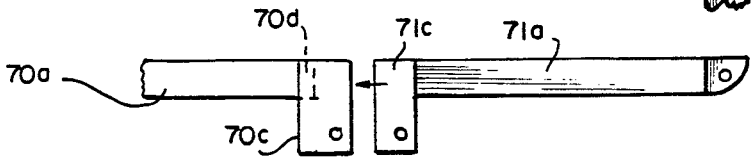
Figure 6C:
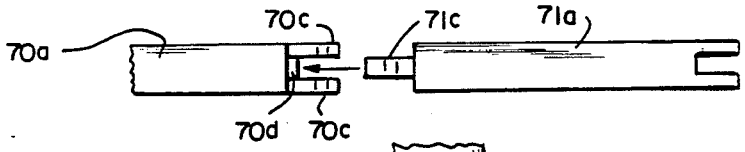

The members 71*a*,71*b* and legs 72,73 are pivotally connected as shown in FIGS. 6A–6C such that the legs 72,73 are perpendicular to and bear against legs 71*a*,71*b* when the carriage is unfolded and are thus restrained from moving inwardly under the load of a patient seated in the wheelchair. Legs 75,76 are restrained from moving inwardly by means of fittings 51*a*,79 (FIG. 10). To support the load of a patient seated in the wheelchair, linkage members 71*a*,71*b* form a rigid beam with members 70*a*,70*b*, as illustrated in FIGS. 6A–6C. Thus, linkage members 71*a*,71*b* each carry a tongue 71*c* that is received between flanges 70*c* of members 70*a*,70*b*. Linkage members 71*a*,71*b* are free to rotate about pin P-1 clockwise, as viewed in FIG. 6A, but they are restrained from rotating in the opposite direction by stop 70*d* carried by members 70*a*,70*b*. The rigid beams thus formed by members 70*a*,71*a* and 70*b*,71*b* are cantilevered from legs 72,73, respectively.

The location of the pivots P-1,P-2 connecting linkage members 71*a*,71*b* to legs 72,73 and to members 70*a*,70*b* is selected to keep the wheels 90,94 level when the carriage C is collapsed. Preferably, pivot P-1 is off-center with respect to seat support member 40, as shown, e.g., FIG. 6A, and is located such that the distance from pin P-1 to pin P-2 is equal to the distance between pin P-1 to pin 78 or 80 for pins located on the same side of the carriage.

The carriage C also includes struts 81*a*,81*b*, which are pivotally connected to members 70*a*,70*b*, respectively, at one end and to members 72,73, respectively, at the other, and struts 82*a*,82*b*, which are pivotally connected to members 71*a*,71*b*, respectively, at one end and to members 76,75, respectively, at the other. Struts 81*a*,81*b*,82*a*,82*b* are in tension when carriage C is fully open and a patient is in the wheelchair 1, and they are thus able to carry the weight of a seated patient without buckling The struts restrain legs 71*a*,71*b*,72 and 73 from moving outwardly. As will be explained below, the struts also enable the carriage A to be automatically folded and unfolded as the seat member 40 is swung about pins 78,80.

Completing the carriage C is spring-loaded locking pin 83 carried by member 71*b*. Carriage C is releasably locked in the fully open position shown in FIGS. 1 and 3 when pin 83 is in the aperture of lug 54(FIG. 4). Carriage C can be collapsed with seat assembly S raised or lowered, but the back assembly B must be in the collapsed position shown in FIG. 6. After the back assembly B is collapsed, pin 83 is depressed against the bias of spring 84 (FIG. 4) to release the pin 83 from lug 54. With the carriage C unlocked, seat support member 40 is swung upwardly about pins 78,80 as seen in FIG. 6, and members 70*a*,70*b*, which are fixed to seat support member 40, are likewise swung upwardly as well. Since members 70*a* and 72 are linked via strut 81*a* and members 71*a* and 76 are linked via strut 82*a*,the relative movement between members 70*a* and 76 as the carriage is being collapsed causes linkage member 71*a* and leg 72 to move in the direction of the arrow A (FIG. 6) toward member 76 to close the carriage Struts 81*b* and 82*b* likewise cause linkage member 71*b* and leg 73 to move to the closed position as member 70*b* is swung with the seat member 40 about pin 80. In this manner, the struts 81*a*,81*b*, 82*a*,82*b* automatically fold or unfold the carriage C as the seat member support 40 is swung upwardly or downwardly about pins 78,80.

FIG. 2 shows the carriage C when fully closed To open the carriage C, it is merely necessary to tip the wheelchair so that it rests on wheel supports 75,76, whereupon the seat support member 40 may be swung downwardly to thereby swing the carriage members in the reverse direction to that described above, whereby the wheelchair 1 is in the open position. Downward pressure on seat 42 will move seat support member 40 downwardly to enable locking pin 83 to enter apertured lug 54 and thus lock the wheelchair 1 in the open position. The front wheels 90 and/or rear wheels 94 may be connected to or detached from carriage C during the collapse or erection of wheelchair 1, as desired.

Driving And Driven Wheels

Wheelchair 1 has removable front wheels 90 that swivel 360°. Each wheel 90 (FIG. 7) comprises arm 91, which telescopes into the wheel support 72 or 75, and a spring-loaded pin 92 which protrudes through a desired aperture 93*a*,93*b*,93*c* in the wheel supports 72,75 to lock wheel 90 in place.

Rear wheels 94 are removably secured to carriage C by means of a grooved pin 95 coaxially mounted on each wheel 94 and a wheel mounting block 96 on each of supports 73,76 (FIG. 8). Block 96 has upper and lower apertures 96*a*,96*b* (FIG. 5) into which the grooved pin 95 may be placed. Operator 97 (FIG. 8) is biased by spring 98 to urge the rod 99 upwardly as viewed in FIG. 8 into apertures 96*a*,96*b*, thereby seating rod 99 into groove 100 of pin 95 to lock the wheel 94 in block 96. To unlock wheel 94, operator 97 is pushed downwardly as viewed in FIG. 8, whereby rod 99 moves downwardly out of groove 100 and the wheel 94 can be removed. To connect wheel 94 to wheelchair 1, it is simply necessary to insert pin 95 into the desired aperture 96*a*,96*b*, whereby pin 95 will move rod 99 against the bias of spring 98 until rod 99 snaps into groove 100.

Wheels 90 and 94 may be adjusted to raise or lower the seat 42 depending on the aperture 93*a*,93*b*,93*c*,-96*a*,96*b* selected, so that a patient sitting in the wheelchair 1 may comfortably place his feet on the ground when entering or exiting from the wheelchair.

Wheels 94 are preferably in the form of a solid circular disc 101 (without spokes) having an integral unitary hub 101*a* and handwheel 102 (FIG. 14), axially spaced from and extending circumferentially around the disc 101. Wheels 94 are most preferably of plastic. Such plastic wheels 94 can be made by any suitable plastic fabrication technique, such as injection molding. Tires 103 complete wheels 94.

A preferred embodiment of the wheels 94 is shown in FIGS. 1 and 14 in which the handwheel 102 has a plurality of axially extending finger-receiving grooves 102*a* extending circumferentially around the handwheel 102. In this manner, a patient may comfortably grasp the handwheel 102 with the aid of the grooves 102*a*.

Figure 17:
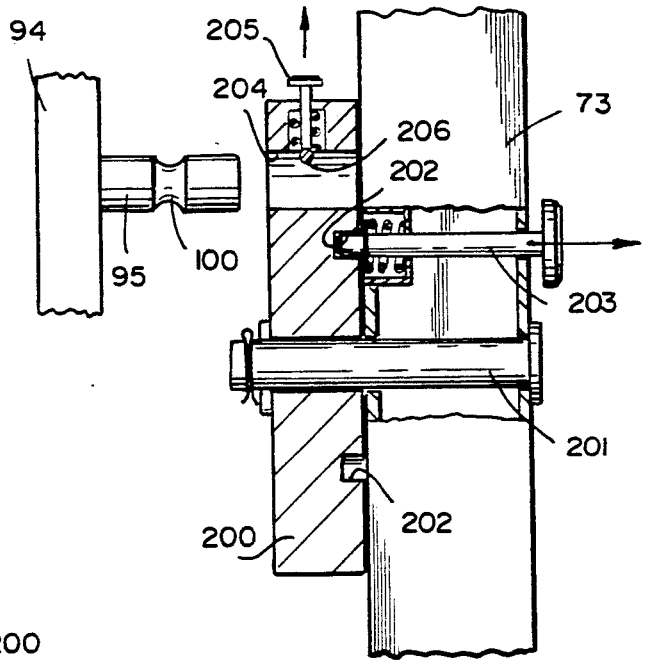
FIG. 17 is a detail view in section in enlarged scale of the rear wheel mounting device of FIG. 16.
Figure 16:
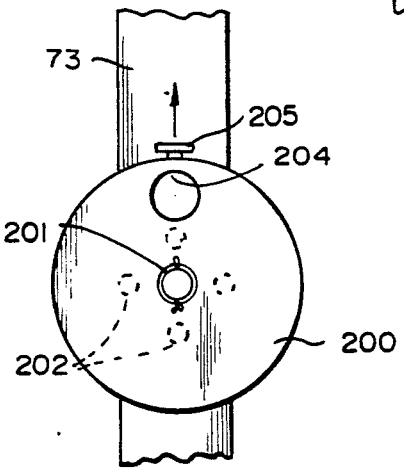
FIG. 16 is a detail view of an alternative mounting device for the rear wheels.

A further preferred embodiment of wheels 94 is shown in FIGS. 16 and 17. In these Figures, the wheel mounting block 96 is replaced by block 200 which is mounted for rotation about pin 201 fixedly secured to leg supports 73,76. Block 200 has four bores 202 therein spaced 90° apart, and spring-loaded locking pin 203 carried by legs 73,76 is arranged to enter a desired bore 202, thereby locking block 200 in place. By rotating block 200 about pin 201, the aperture 204 can be indexed to one of four desired positions and locked in place by locking pin 205. Wheel 94 is inserted into aperture 204 by pulling spring-loaded locking pin 205 and sliding grooved pin 95 into aperture 204. Wheel 94 is removed by pulling locking pin 205 to release seating rod 206 from groove 100.

Wheelchair 1 can be raised or lowered by rotating block 200 to place aperture 204 in the twelve o'clock or six o'clock positions as viewed in FIG. 16. The wheelbase of wheelchair 1 can be decreased or increased by choosing the three o'clock or nine o'clock positions.

Adjustable And Retractable Leg Supports

Wheelchair 1 also includes adjustable and retractable leg supports assemblies L, as seen in FIG. 1. In particular a pair of leg support assemblies 110 are provided, which are located between arms 48,53 and 49,53. For simplicity only one assembly 110 is shown in the drawings, except for FIG. 1.

Leg support assemblies 110 (FIGS. 10–13) comprise adjustable telescoping members 111 and 112. Distal member 111 has a spring-loaded pin 113 projecting therefrom that cooperates with apertures 114 in proximal member 112 to permit distal member 111 to be moved in or out of proximal member 112 to the desired location and then locked in place. Footrest 115 is rotatably secured to member 111 by means of pins 111*a* which are fixed to member 111 and which extend into slots 115*a* in the opposed sides 115*b* of footrest 115.

Footrest 115 is shown in the retracted position in full line in FIG. 10. Footrest 115 is raised to the extended position shown in dotted line in FIG. 10 by swinging it upwardly in the direction of the arrow, whereby footrest 115 will be swung about pins 111*a* such that the tip 115*c* will swing upwardly while rear end 115*d* will fall downwardly with respect to pins 111*a*. Sufficient clearance between rear end 115*d* and the end wall of member 111 is provided to allow footrest 115 to be swung between the extended and retracted positions. Footrest 115 is retracted by swinging tip 115*c* downwardly.

A pair of tubular housing assemblies 116 are rotatably mounted between arms 48,53 and arms 49,53, each assembly 116 including a shaft 117 journaled in arm 53 and a shaft 118 journaled in arm 49 or 48. Each shaft 118 carries a toothed ratchet 119. Pawl 120 is supported by pin 121 extending between arm 49 and lug 122 (FIGS. 5 and 10) and another pawl (not shown) is provided between arm 48 and its corresponding lug 123 (FIG. 10).

Figure 13:
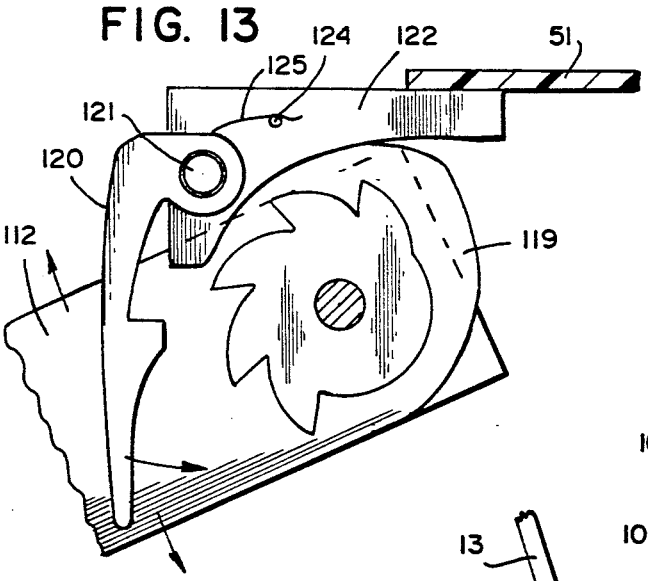
FIG. 13 is a detail view, in section, in enlarged scale of the locking mechanism for the leg support assembly.

As best seen in FIG. 13, the lug 122 is secured to upper front frame member 51 and carries a post 124. Spring 125 is carried by pin 121 and is secured at one end to post 124 and at the other end (not shown) to pawl 120 so as to urge pawl 120 into engagement with the teeth of ratchet 119, whereby the ratchet 119 and pawl 120 lock housing assembly 116 in place. With housing assembly 116 locked in the position shown in FIG. 11, leg assembly 110 may be slid within tubular housing assembly 116 toward or away from the rear of wheelchair 1 to retract leg assembly 110 for storage within seat support member 40 or to extend it for use, respectively. When leg assembly 110 is fully extended as shown in FIG. 10, stop 124 engages a slot (not shown) in housing 116, thereby limiting further movement of assembly 110. In this position, the rear most end 112*a* of member 112 will clear upper frame support member 51. Pawl 120 is then released by pulling it away from ratchet 119, the extended leg assembly 110 (and thus housing 116) is swung to the desired position and the pawl 120 is allowed to reengage ratchet 119 under the bias of spring 125 at the desired position. To retract leg assembly 110, the assembly 110 is raised to the horizontal, with pawl 120 riding freely over the ratchet 119, and is pushed rearwardly.

Braking System And Handles

Wheelchair 1 is provided with handles 140 (FIGS. 9 and 9A) that are pivotally mounted to uprights 10 to swing between the operating position shown in FIG. 9 and the retracted position shown in FIG. 9A. Handles 140 may be used by a person to push the wheelchair 1.

A braking system is also provided, as shown in FIGS. 14 and 15, comprising a handgrip 141 mounted on an arm 12 by means of brackets 142 and 143. Preferably, handgrip 141 is mounted at the free end of arm 12 to be as far as possible from wheel 94.

In particular, operating lever arm 144 is pivotally mounted on bracket 142 while spring biased ratchet arm 145 is pivotally mounted on bracket 143. Brake pads 146 are secured to bell cranks 147 carried by uprights 10, and cable 148 connects the bell cranks 146 to operating lever arm 144. The braking system is activated by pulling end 144*a* upwardly, thereby tensioning cable 148 to urge brake pads 146 into contact with wheels 94. Pawl 144*b* slides over teeth 145*a* of ratchet 145 as the lever arm 144 is being pulled upwardly and is then locked in place by ratchet 145 when the lever 144 is released, thereby locking brake pads 146 against wheels 94 to thus lock wheelchair 1. Ratchet 145 is urged into locking engagement with pawl 144*b* by spring 147 and is unlocked by swinging ratchet 145 about its pivot 149 against the bias of spring 147 whereupon the tension in cable 148 is released and brake pads 146 no longer engage wheels 94. Wheelchair 1 is thus free to move.

Adjustable Headrest

Figure 18:
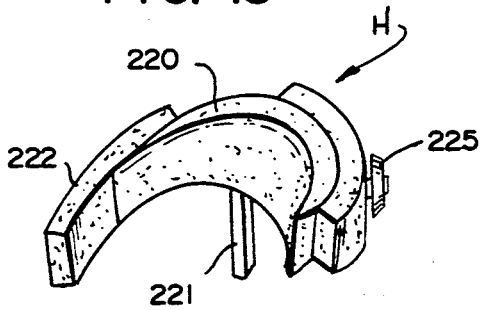
FIG. 18 is a perspective view of the headrest of the invention.
Figure 19:
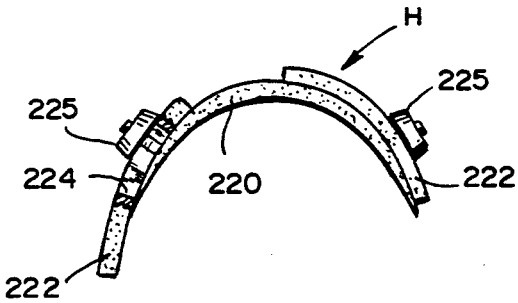
FIG. 19 is an elevational view, partly in section, of the headrest of FIG. 18.

Headrest H is shown in detail in FIGS. 18 and 19 and comprises a central member 220 having a depending shaft 221 that is removably secured to backrest 14 by any suitable means (not shown). Adjustable members 222 are slidably mounted on central member 220 by means of bolts 223 that are secured to central member 220 and extend through slots 224 in each adjustable member 222. The free end of each bolt 224 is threadedly secured to an adjusting knob 223, which can be loosened to allow an adjustable member 222 to be moved to any desired position and then tightened to lock adjustable member 222 in place. FIG. 19 shows the left and right adjustable members 222 in their fully extended and fully retracted positions, respectively. Suitably, members central member 220 and adjustable members are made of soft plastic.

I claim:

1. In a folding wheelchair comprising a collapsible carriage having normally vertical opposed first and second sides, a normally horizontal seat having front, rear and side portions carried between said sides, and folding means for collapsing said carriage from an in-use unfolded position and an in-storage folded position in which said sides are closely adjacent and said seat is transverse to the horizontal position, the improvement which comprises:

a. a rigid seat assembly carried by said carriage, said rigid seat assembly having a normally horizontal upper surface for supporting a person and a normally horizontally extending compartment below said upper surface and opening at said front portion of said rigid seat;

b. said folding means including hinge means for connecting one side portion of said normally horizontal seat to said first side of said carriage and means for as automatically folding and unfolding said carriages said rigid seat is swung about said hinge means between said horizontal and transverse positions;

c. a pair of leg support members stored side-by-side in said compartment and being independently movable out of said compartment via said opening to a desired in-use position; and d. said rigid seat assembly further comprises a normally horizontal rigid seat support member secured to said carriage, said compartment being provided in said seat support member, a movable rigid seat member mounted above said seat support member for movement relative to said seat support member between a lowered position closely adjacent said seat support member and a raised position remote from said seat support member, locking means for locking said movable seat member in each said position, and operating means for unlocking said locking means to enable said movable seat member to be moved from one position to the other.

2. The wheelchair according to claim 1, wherein said movable seat member and said seat support member have corresponding front, rear and side portions, normally engaged cooperating latching members are carried by the rear portions of said seat members, said latching members, when engaged, maintaining the rear portion of said movable seat member in the locked position after said locking means is unlocked, whereby only said front portion of said movable seat member may be moved to said raised position, and unlatching means is provided for disengaging said engaged latching members, whereby said rear portion of said movable seat member may be moved to said raised position.

3. In a folding wheelchair comprising a collapsible carriage having normally vertical opposed first and second sides, a normally horizontal seat having front, rear and side portions carried between said sides, and folding means for collapsing said carriage from an in-use unfolded position and an in-storage folded position in which said sides are closely adjacent and said seat is transverse to the horizontal position, the improvement which comprises:

a. a rigid seat assembly carried by said carriage, said rigid seat assembly having a normally horizontal upper surface for supporting a person and a normally horizontally extending compartment below said upper surface and opening at said front portion of said rigid seat;

b. said folding means including hinge means for connecting one side portion of said normally horizontal seat to said first side of said carriage and means for automatically folding and unfolding said carriage as said rigid seat is swung about said hinge means between said horizontal and transverse positions;

c. a pair of leg support members stored side-by-side in said compartment and being independently movable out of said compartment via said opening to a desired in-use position; and d. each leg support member comprises a distal portion telescopically mounted in a proximal portion, said telescoping portions having cooperating selectively releasable locking means for allowing relative telescopic movement between said portions and for locking said portions in any desired position.

4. The wheelchair according to claim 3, wherein said distal portion has a footrest at its outermost end, said footrest being swingably mounted on said distal portion for movement between a retracted position in which it will fit within said proximal portion when said portions are telescoped together, and an extended position in which it is perpendicular to said distal portion.

5. A folding wheelchair, which comprises a collapsible carriage having normally vertical opposed first and second sides, a driving wheel and a driven wheel supported by each said side of said carriage, a normally horizontal rigid seat carried by said carriage between said sides, said rigid seat having front, rear and opposed side portions, and folding means for collapsing said carriage from an in-use unfolded position to an in-storage folded position in which said sides are closely adjacent one another and said rigid seat is transverse to the horizontal, said folding means comprising hinge means for connecting one side portion of said normally horizontal seat to the top of said first side of said carriage, first and second elongated linkage members each pivotally connected at a respective one end thereof to said second side of said carriage and each pivotally connected at the respective other end thereof to said rigid seat, first and second elongated strut means pivotally connected at each end thereof between said first and second linkage members, respectively, and said first side of said carriage, and third and fourth elongated strut means pivotally connected at each end thereof between said rigid seat and said second side of said carriage; wherein each said side of said carriage comprises two normally vertical leg portions, each said leg portion being arranged adjacent a corner of said rigid seat when said carriage is in said in-use position; the top of each leg portion of said second side is below and supports the other side portion of said rigid seat when said carriage is in said in-use unfolded position; said first and second linkage members each being pivotally connected between the top of one said leg portion of said second side and said rigid seat; said third and fourth strut means each being pivotally connected between said rigid seat and one said leg portion of said second side; and the top of each said leg portion of said first side is hingedly connected by said hinge means to said rigid seat adjacent the top of said rigid seat, said first and second strut means being each pivotally connected to one said leg portion of said first side and to said first and second linkage members, respectively; and said strut means swinging said linkage members and said second side about said pivots to automatically fold and unfold said carriage as said rigid seat is swung about said hinge means between said horizontal and transverse positions.

6. In a wheelchair having a carriage, a driving wheel and a driven wheel carried by opposed sides of said carriage and a normally horizontal seat supported by said carriage between said sides, the improvement which comprises a rigid seat assembly having a normally horizontal position, said seat assembly having a seat support member affixed to said carriage; and a pair of leg assemblies rotatably mounted on said seat support member, each including a leg support member slidably movable between a horizontal retracted position in which said leg support member is stored within said seat support member and a position in which said leg support member extends horizontally out of said seat support member, said extended leg support members each being selectively swingable between said horizontal extended position and a desired in-use position.

7. The wheelchair according to claim 6, wherein said leg assemblies each include a tubular housing member carrying a said leg support member for sliding movement therein, said housing members being rotatably mounted on said seat support member for swinging between a horizontal position and an in-use position when its associated leg support member is fully extended out of said seat support member, and means for selectively locking each said housing member in any desired position to which it is swung.

8. The wheelchair according to claim 7, wherein means is provided for preventing said housing from being swung away from said horizontal position unless a said foot support member therein is fully extended.

9. The wheelchair according to claim 7, wherein each said leg support member has a proximal portion carried by said housing member and a distal portion telescopically mounted in a proximal portion, said telescoping portions having cooperating selectively releasable locking means for allowing relative telescopic movement between said portions and for locking said portions in any desired position.

10. The wheelchair according to claim 7, wherein said distal portion has a footrest at its outermost end, said footrest being swingably mounted on said distal portion for movement between a retracted position in which it will fit within said proximal portion when said portions are telescoped together, and an extended position in which it is perpendicular to said distal portion.

11. In a wheelchair having a carriage, a driving wheel and a driven wheel carried by opposed sides of said carriage and a seat supported by said carriage between said sides, the improvement which comprises a rigid seat assembly comprising a normally horizontal rigid seat support member secured to said carriage, a movable rigid seat member mounted above said seat support member for movement relative to said seat support member between a lowered position closely adjacent said seat support member and a raised position remote from said seat support member, locking means for locking said movable seat member in each said position, and operating means for unlocking said locking means to enable said movable seat member to be moved from one position to the other.

12. The wheelchair according to claim 11, wherein first spring means is provided for urging said movable seat member to said raised position, said movable seat member, when unlocked, being movable by said first spring means from said lowered position to said raised position and being manually movable against the bias of said first spring means from said raised position to said lowered position.

13. The wheelchair according to claim 12, wherein said locking means comprises a plurality of elongated plate means pivotally mounted to said movable seat member at one end thereof and depending from said movable seat member, each said plate means having an aperture therein comprising a longitudinally extending portion terminating at each end in transversely extending portions, a plurality of pins carried by said seat support member, each said pin being associated with one of said plate means and extending through said aperture of its associated plate means, said plate means being swingably movable between a locked position in which a said pin is in one of the transverse portions of said aperture of its associated plate means and an unlocked position in which a said pin is in the longitudinal portion of said aperture, linkage means for linking said plate means to said operating means, and second spring means for urging each said plate means to said locked position, said plate means being swung to the unlocked position by operation of said operating means via said linkage means against the bias of said second spring means and being swung back to said locked position by said second spring means, said movable seat member being movable between said lowered and raised positions when said pins are in the longitudinal portions of said apertures.

14. The wheelchair according to claim 11, wherein said movable seat member and said seat support member have corresponding front, rear and side portions, normally engaged cooperating latching members are carried by the rear portions of said seat members, said latching members, when engaged, maintaining the rear portion of said movable seat member in the locked position after said locking means is unlocked, whereby only said front portion of said movable seat member may be moved to said raised position, and unlatching means is provided for disengaging said engaged latching members, whereby said rear portion of said movable seat member may be moved to said raised position.

15. In a folding wheelchair comprising a collapsible carriage having an in-use unfolded position and an in-storage folded position, a driving wheel and a driven wheel carried by opposed sides of said carriage and a normally horizontal seat supported by said carriage between said sides, the improvement which comprises a normally horizontal rigid seat having front, rear and side portions, hinge means for connecting one side portion of said rigid seat to a side of said carriage, said rigid seat being swingably movable about said hinge means between said normal horizontal position for supporting a seated person and a position transverse thereto when said carriage is folded, a rigid backrest swingably mounted to said rigid seat at the rear portion thereof, said rigid backrest being swingable between an in-use upright position for supporting the back of a patient seated on said rigid seat when said carriage is in the unfolded position and an in-storage position in which said rigid backrest confronts said rigid seat when said carriage is in the folded position and releasable locking means for locking said backrest in the upright position; and elongated armrests each pivotally mounted at one end there to opposed sides of said backrest, said armrests extending from said backrest toward said front portion of said rigid seat, and an elongated linkage member pivotally connected, at each end thereof, between said other ends of each of said armrests and said rigid seat, said armrests being swingable between a normally horizontal in-use position when said carriage is in the unfolded position and an in-storage position in which said arms confront said rigid seat when said carriage is in the folded position.

16. The wheelchair according to claim 15, wherein said armrests each have a longitudinally extending slot therein, each said linkage member carrying a pin extending through said slot and pivotally connecting each said linkage member to its associated armrest, each said armrest being swingable between its normally horizontal in-use position and a raised position in which said armrest confronts said backrest when said backrest is in its in-use upright position, said pins being slidably movable in their associated slots relative to said armrests as said armrests are swung between said horizontal and raised positions.

17. The wheelchair according to claim 15, wherein said armrests are independently swingable between said positions.

18. The wheelchair according to claim 15, wherein said backrest includes selectively adjustable means for moving said backrest between said upright position and a desired reclined position.

19. The wheelchair according to claim 15, wherein said armrests and said linkage members having cooperating means for enabling said armrests to be swung between said positions while remaining connected to said linkage members.

20. In a folding wheelchair comprising a collapsible carriage having normally vertical opposed first and second sides, a normally horizontal seat having front, rear and side portions carried between said sides, and folding means for collapsing said carriage from an in-use unfolded position and an in-storage folded position in which said sides are closely adjacent and said seat is transverse to the horizontal position, the improvement which comprises:

a. a rigid seat assembly carried by said carriage, said rigid seat assembly having a normally horizontal upper surface for supporting a person and a normally horizontally extending compartment below said upper surface and opening at said front portion of said rigid seat;

b. said folding means including hinge means for connecting one side portion of said normally horizontal seat to said first side of said carriage and means for automatically folding and unfolding said carriage as said rigid seat is swung about said hinge means between said horizontal and transverse positions;

c. a pair of leg support members stored side-by-side in said compartment and being independently movable out of said compartment via said opening to a desired in-use position; and d. said leg support members being rotatably mounted on said wheelchair, said leg support members being independently movable out of said compartment via said opening to a horizontal extended position and being selectively movable between said horizontal extended position and said desired in-use position.

21. In a wheelchair having a carriage, a driving wheel carried by each opposed side of said carriage and a normally horizontal seat supported by said carriage between said sides, the improvement wherein each of said driving wheels has a pin coaxially mounted thereon and terminating in a circumferentially grooved free end; a driving wheel support member is provided on each side of said carriage, each said support member comprising a block mounted on said carriage for rotation in a vertical plane, each said block having a pin-receiving bore for receiving a said grooved pin and a plurality of spaced-apart index bores and spring-loaded locking means biased to enter the groove of a pin inserted into said pin-receiving bore, whereby said driving wheel is releasably locked in said block; said block being rotatable to thereby bring a selected one of said index bores to an indexing location and a spring-loaded indexing pin is carried by said carriage and is biased to enter an index bore at said indexing location and thereby lock said block; a said pin-receiving bore being disposed at a selected one of a plurality of positions when a corresponding index bore is at said indexing location.

22. The wheelchair according to claim 21, wherein said plurality of index bores is arranged in said block so as to releasably lock said block with said pin-receiving bore in one of a plurality of vertically and horizontally spaced-apart positions, whereby the height and the wheelbase of the wheelchair can be adjusted.

23. The wheelchair according to claim 22, wherein said plurality of index bores comprises a set of two index bores corresponding to two horizontally spaced-apart positions of said pin-receiving bore and a set of two index bores corresponding to two horizontally spaced-apart positions of said pin-receiving bore.

24. In a folding wheelchair comprising a collapsible carriage having normally vertical opposed first and second sides, a normally horizontal seat having front, rear and side portions carried between said sides, and folding means for collapsing said carriage from an in-use unfolded position and an in-storage folded position in which said sides are closely adjacent and said seat is transverse to the horizontal position, the improvement which comprises:

a. a rigid seat assembly carried by said carriage, said rigid seat assembly having a normally horizontal upper surface for supporting a person and a normally horizontally extending compartment below said upper surface and opening at said front portion of said rigid seat;

b. said folding means including hinge means for connecting one side portion of said normally horizontal seat to said first side of said carriage and means for automatically folding and unfolding said carriage as said rigid seat is swung about said hinge means between said horizontal and transverse positions;

c. a pair of leg support members stored side-by-side in said compartment and being independently movable out of said compartment via said opening to a desired in-use position; and d. a rigid brackrest swingably mounted to said rigid seat at the rear portion thereof, said rigid backrest being swingable between an in-use upright position for supporting the back of a patient seated on said rigid seat when said carriage is in the unfolded position and an in-storage position in which said rigid backrest confronts said rigid seat when said carriage is in the folded position, and releasable locking means for locking said backrest in the upright position; and e. elongated armrests each pivotally mounted at one end thereof to opposed sides of said backrest, said armrests extending from said backrest toward said front portion of said rigid seat, an elongated linkage member pivotally connected at each end thereof to said other ends of each of said arm rests and to said rigid seat assembly, said armrests and said linkage means having cooperating means for enabling said armrests to be swung while remaining connected to said linkage members between a normally horizontal in-use position when said carriage is in the unfolded position and an in-storage position in which said armrests confront said rigid seat when said carriage is in the folded position.

* * * * *